US010062305B1

(12) United States Patent
Orr

(10) Patent No.: US 10,062,305 B1
(45) Date of Patent: Aug. 28, 2018

(54) CUSTOMIZED STORAGE CALENDAR

(71) Applicant: Tina Faith Orr, Kathleen, GA (US)

(72) Inventor: Tina Faith Orr, Kathleen, GA (US)

(73) Assignee: Tina Faith Orr, Kathleen, GA (US)

( * ) Notice: Subject to any disclaimer, the term of this patent is extended or adjusted under 35 U.S.C. 154(b) by 0 days.

(21) Appl. No.: 15/807,472

(22) Filed: Nov. 8, 2017

Related U.S. Application Data

(63) Continuation-in-part of application No. 15/284,418, filed on Oct. 3, 2016, now Pat. No. 9,844,967.

(60) Provisional application No. 62/269,727, filed on Dec. 18, 2015.

(51) Int. Cl.
*G09D 3/00* (2006.01)
*G09D 3/02* (2006.01)
*A47G 33/00* (2006.01)

(52) U.S. Cl.
CPC ..... *G09D 3/02* (2013.01); *A47G 33/00* (2013.01)

(58) Field of Classification Search
CPC ... G09D 3/00; G09D 3/04; G09D 3/02; G09F 3/02
See application file for complete search history.

(56) References Cited

U.S. PATENT DOCUMENTS 1,200,348 A * 10/1916 Hawk ..... G09D 3/02 40/107
1,568,729 A * 1/1926 Gearon ..... A47B 49/00 135/90
3,225,913 A * 12/1965 Lee ..... B65D 83/0445 206/232
3,594,923 A * 7/1971 Midgley ..... G09B 23/24 434/298
4,125,954 A * 11/1978 Barbieri ..... G09D 3/02 40/107
6,186,553 B1 * 2/2001 Phillips ..... B42D 5/04 283/2
6,223,912 B1 * 5/2001 Nerushai ..... A47F 1/12 206/459.5
D460,254 S * 7/2002 Rufo ..... D3/203.3
7,690,690 B1 * 4/2010 Campbell ..... G04G 9/00 283/2
D660,583 S * 5/2012 Mlinarevic ..... D3/203.3
(Continued)

FOREIGN PATENT DOCUMENTS

JP 2013179968 A * 9/2013
KR 101846538 B1 * 4/2018

*Primary Examiner* — Cassandra Davis

(57) ABSTRACT

A Customized Storage Calendar including a backboard, calendar frame, partitions, configured as rows and columns, to define storage compartments, day boxes displaying the day number and positive subject indicia on a removable insert secured by tabs or on a removable top wall slider which are refillable, month box configured as left or right side insert which provides storage for remaining sliders displaying the current month slider, optional year sliders, and optional academia subject or positive subject indicia, horizontal support member, and a week face plate. The Customized Storage Calendar is shown configured with 31 dual-sided day boxes and 7 six wall day boxes displaying positive subject indicia on a removable insert, and 7 five wall cube day boxes displaying positive subject indicia on a removable top wall slider. Each day box is adapted to receive and store an object therein.

6 Claims, 16 Drawing Sheets

(56) References Cited

U.S. PATENT DOCUMENTS

| | | | | |
|---|---|---|---|---|
| 2001/0036127 | A1* | 11/2001 | McCravy | B42D 5/042 368/28 |
| 2009/0007467 | A1* | 1/2009 | Bowman | G09D 3/04 40/107 |
| 2010/0206765 | A1* | 8/2010 | Fonte | A61J 7/04 206/534 |
| 2013/0195326 | A1* | 8/2013 | Bear | G06F 19/3456 382/128 |
| 2015/0108035 | A1* | 4/2015 | Delforte | B42D 5/047 206/562 |

* cited by examiner

38

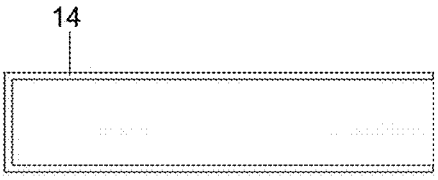
FIG. 13A
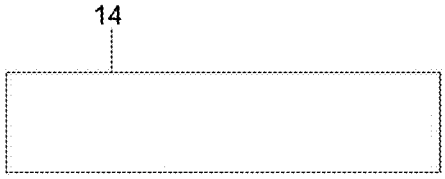
FIG. 13B
FIG. 13C
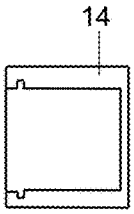
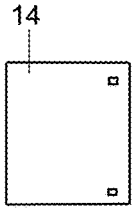
FIG. 13D
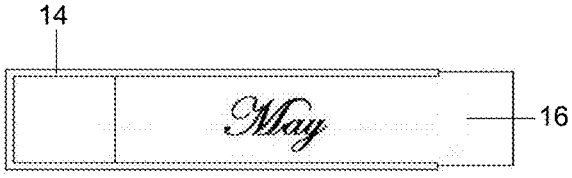
FIG. 13E
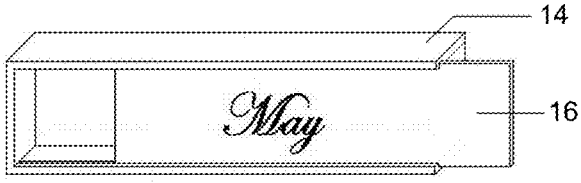
FIG. 13F
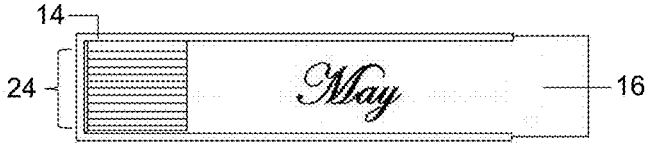
FIG. 13G
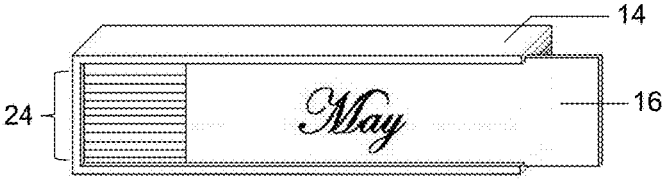
FIG. 13H

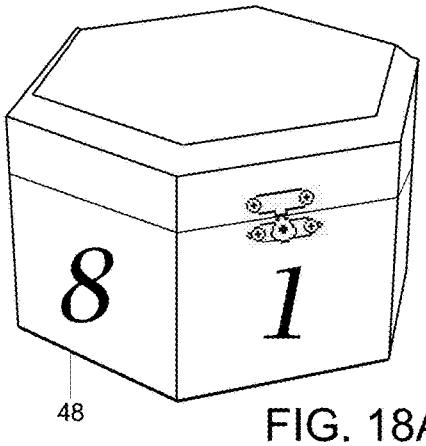
FIG. 18A
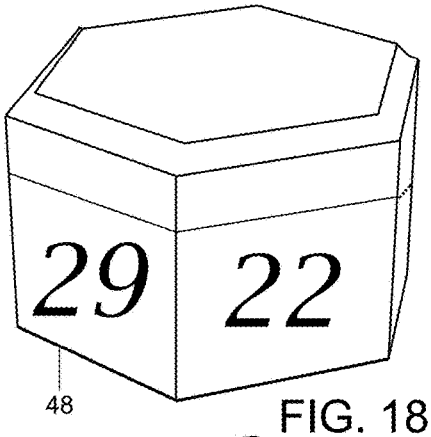
FIG. 18B
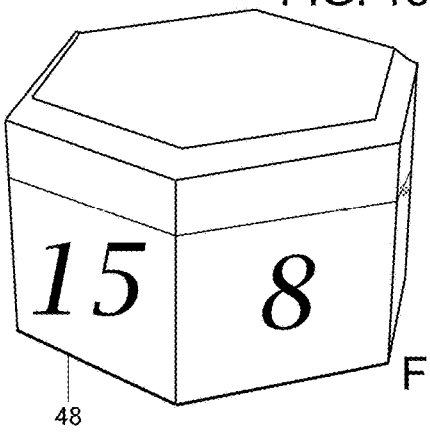
FIG. 18C
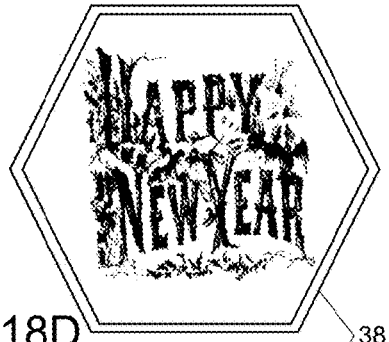
FIG.18D
38
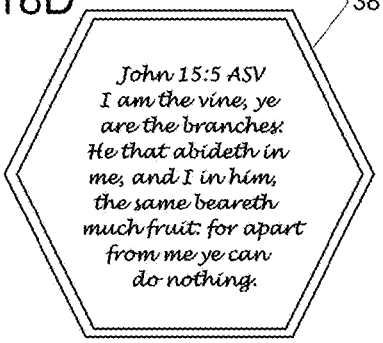
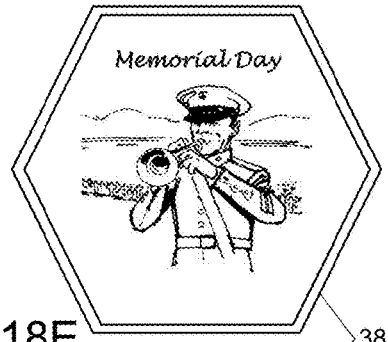
FIG.18E
38
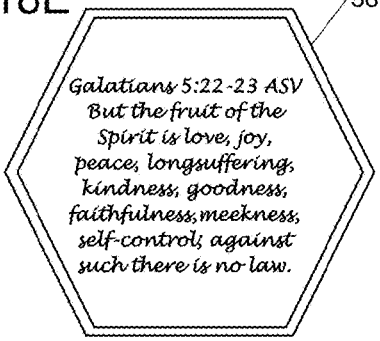

52

52

CUSTOMIZED STORAGE CALENDAR

CROSS-REFERENCE TO RELATED APPLICATIONS

U.S. Non-Provisional application Ser. No. 15/284,418 filed on Oct. 3, 2016

U.S. Provisional Application No. 62/269,727 filed on Dec. 18, 2015

This application claims priority to and is a Continuation-In-Part of U.S. application Ser. No. 15/284,418, filed Oct. 3, 2016, which claims the benefit of U.S. Provisional Application No. 62/269,727, filed Dec. 18, 2015. The entire content of these related applications is hereby incorporated herein by reference.

BACKGROUND OF THE INVENTION

Field of the Invention

The present invention relates to calendars. More specifically, this invention is a reusable Customized Storage Calendar which can be configured as a devotional calendar.

Description of the Related Art

There are many calendars available in various formats including paper, electronic, computer generated, and others. Advent calendars observe religious celebrations only during the Christmas year 25 days and typically offering one chocolate per countdown day which allows for only one person to enjoy the chocolate. Tear off paper calendars are not reusable. Currently, available calendars on the market cannot be customized to accommodate a variety of desserts such as wrapped chocolates, mints, and candies.

BRIEF SUMMARY OF THE INVENTION

Disclosed herein is a reusable Customizable Storage Calendar consisting of a backboard, month box with optional year sliders and optional month slider positive subject indicia, week face plate, horizontal support member, a calendar frame comprising a top wall, bottom wall, left wall, and right wall for supporting the inner compartments, formed by horizontal partitions and vertical partitions, which hold the dual-sided day boxes. The month box, containing twelve month sliders, is removably mounted on the top wall of the calendar frame. The week face plate is sandwiched between the top wall of the calendar frame and the horizontal support member.

Traditional rituals include people giving thanks and blessing prayers prior to the main meal. This invention is shown customized as a devotional calendar, allowing for the creation of a post-dinner ritual for a daily spiritual, religious devotional to be read prior to dessert, thus establishing a new family tradition. Day box embodiments are shown which can be used to store objects. Month box embodiments are shown displaying the month and optional year on the front side of the sliders and academia subjects on the back side of the sliders. The day boxes top wall and the back side of the month box sliders can be configured to display positive subject indicia.

BRIEF DESCRIPTION OF THE DRAWINGS

Views

FIG. 13A is the front view of the Calendar Month Box without any month sliders inserted.

FIG. 13B is the top, bottom, and back side view of the Calendar Month Box without any month sliders inserted.

FIG. 13C is the side right view of the Calendar Month Box without any month sliders inserted.

FIG. 13D is the left side view of the Calendar Month Box without any month sliders inserted.

FIG. 13E is the front view of the Calendar Month Box, with remainder of the month sliders removed from the interior box storage area, displaying the month of May to illustrate the sliding action of the current month slider being inserted.

FIG. 13F is a perspective view of the Calendar Month Box, with remainder of the month sliders removed from the interior box storage area, displaying the month of May to illustrate the sliding action of the current month slider being inserted.

FIG. 13G is the front view of the Calendar Month Box, storing the remainder non-current month sliders, displaying the month of May to illustrate the sliding action of the current month slider being inserted.

FIG. 13H is a perspective view of the Calendar Month Box, storing the remainder non-current month sliders, displaying the month of May to illustrate the sliding action of the current month slider being inserted.

FIG. 18A, FIG. 18B, and FIG. 18C is a perspective view of the six wall day boxes.

FIG. 18D is a front and back view of the dual-sided insert for day 1.

FIG. 18E is a front and back view of the dual-sided insert for day 29 of year 2017.

REFERENCE NUMERALS IN THE DRAWINGS

Figure 1:
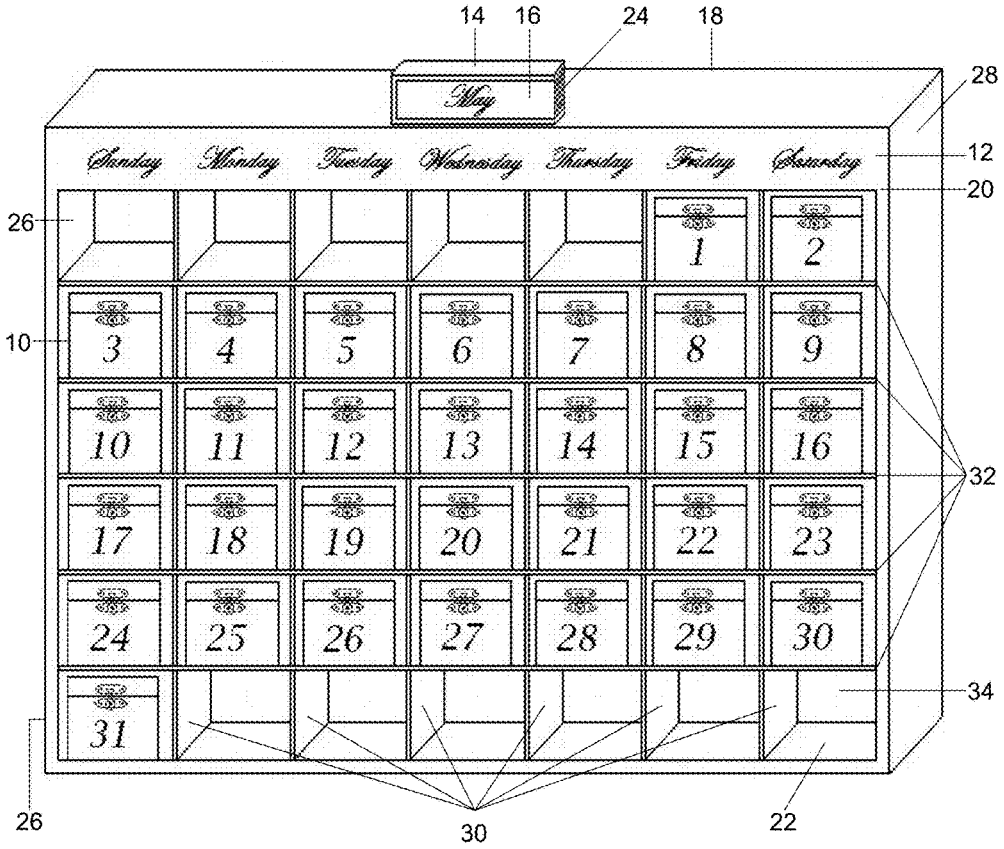
FIG. 1 is a perspective view of the Customized Storage Calendar configured with dual-sided day boxes and a month box.

| Reference numerals | |
|---|---|
| 10 Dual-sided Day Boxes | 12 Week Face Plate |
| 14 Month Box | 16 Current Month Slider |
| 18 Top Wall | 20 Horizontal Support Member |
| 22 Bottom Wall | 24 Non-Current Month Sliders |
| 26 Left Wall | 28 Right Wall |
| 30 Vertical Partitions | 32 Horizontal Partitions |
| 34 Backboard | 36 Day Boxes Alternate Embodiments |
| 38 Insert | 40 Tab |
| 42 Year Number Slider | 44 Year Number Sliders |
| 46 Academia Sliders | 48 Six Wall Day Boxes |
| 50 Cube Day Boxes | 52 Top Wall Slider |

DETAILED DESCRIPTION OF THE INVENTION

FIG. 1 shows a perspective view of the Customized Storage Calendar in the fully assembled state with the thirty-one day boxes 10 displaying positive subject indicia on the top wall on a removable dual-sided insert 38 secured by tabs 40 and a day number displayed on the front wall. The Customized Storage Calendar comprises a backboard 34, top wall 18, bottom wall 22, left wall 26, right wall 28 for supporting the five horizontal partitions 32 and six vertical partitions 30. The five horizontal partitions and six vertical partitions define forty-two compartments, configured as 6 rows and 7 columns, which hold the thirty-one day boxes 10. Each day box has a number displayed on the front wall corresponding to the day, along with information on a dual-sided insert 38 secured by tabs 40 that can be customized to any positive subject area displayed on the top wall of each box. The Customized Storage Calendar also comprises a horizontal support member 20 for supporting the week face plate 12 which displays seven days of the week, and a month box 14 which holds the twelve month sliders 16, 24. The Customized Storage Calendar also has 6 rows which adequately displays all days of the month. In the year 2017, the months of April, July, and December require 6 rows to adequately display all days. In the year 2018, the months of September and December require 6 rows to adequately display all days. Many calendars contain only 5 rows which does not adequately display all days of some months.

Seven days of the week are displayed on the week face plate 12 below the month box 14. The week face plate is sandwiched between the top wall 18 of the calendar frame and the horizontal support member 20.

The month box 14 is removable mounted on the top wall 18 of the calendar frame above the week face plate 12. The current month slider 16 easily slides out of the month box 14 for swapping out the month. The non-current month sliders 24 easily slide behind the current month slider 16 and are stored in the hollow interior storage area of the month box 14.

Customized Storage Calendars composed of wood material should be wall mounted on studs. Customized Storage Calendars composed of paper or cardboard material are tabletop and can be supported by a backing if necessary. The Customized Storage Calendar can be glued and/or folded and jointed depending on the material. The material choice for the calendar is durable, cuttable material that is capable of receiving indicia to display the months, days of the week, numeric day of the month (1-31), and positive subject matter. As used herein, the term "indicia" refers to a depiction including printed, numerical, artistic, customized, religious, or educational matter, and also including indications of calendar information such as month, day number, and day of week. Indicia displayed on the calendar can be printed, lasered, engraved, or screen printed onto material such as wood, cardboard, or other suitable material.

Figure 2:
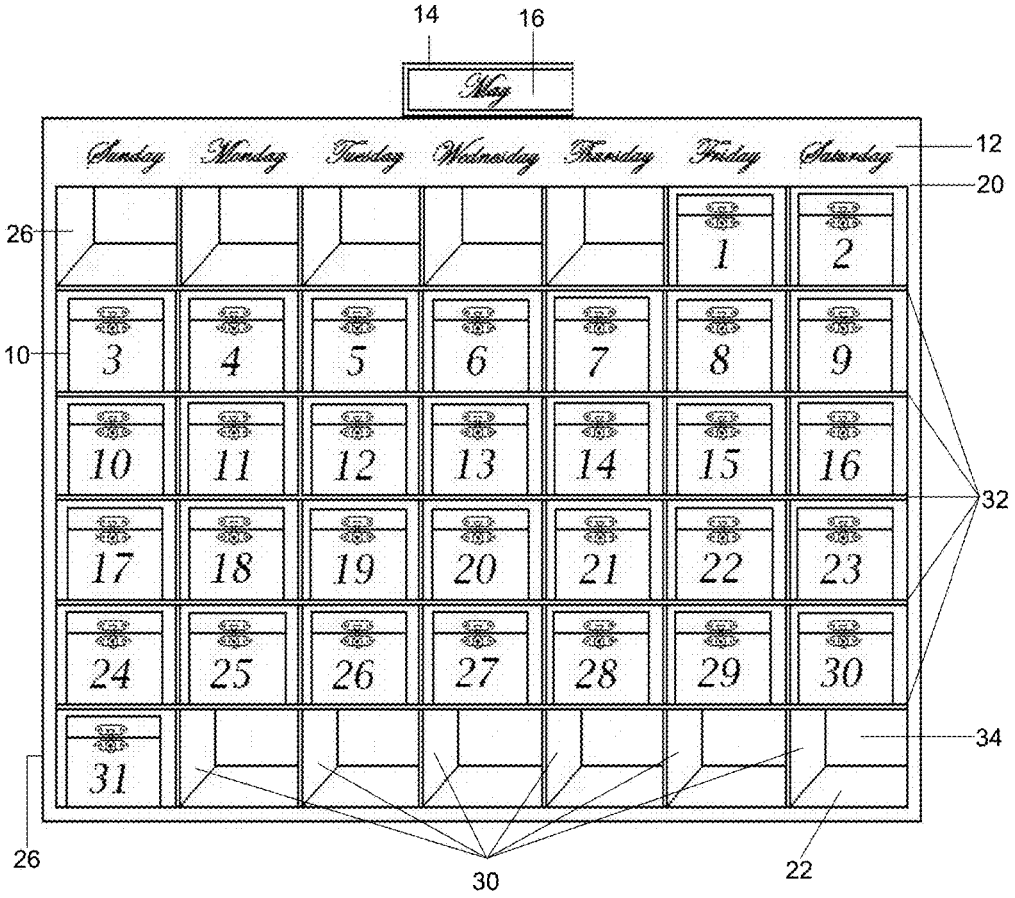
FIG. 2 is the front view of the Customized Storage Calendar.

FIG. 2 is the front view of the Customized Storage Calendar configured with dual-sided day boxes 10 and month box 14.

Figure 3:
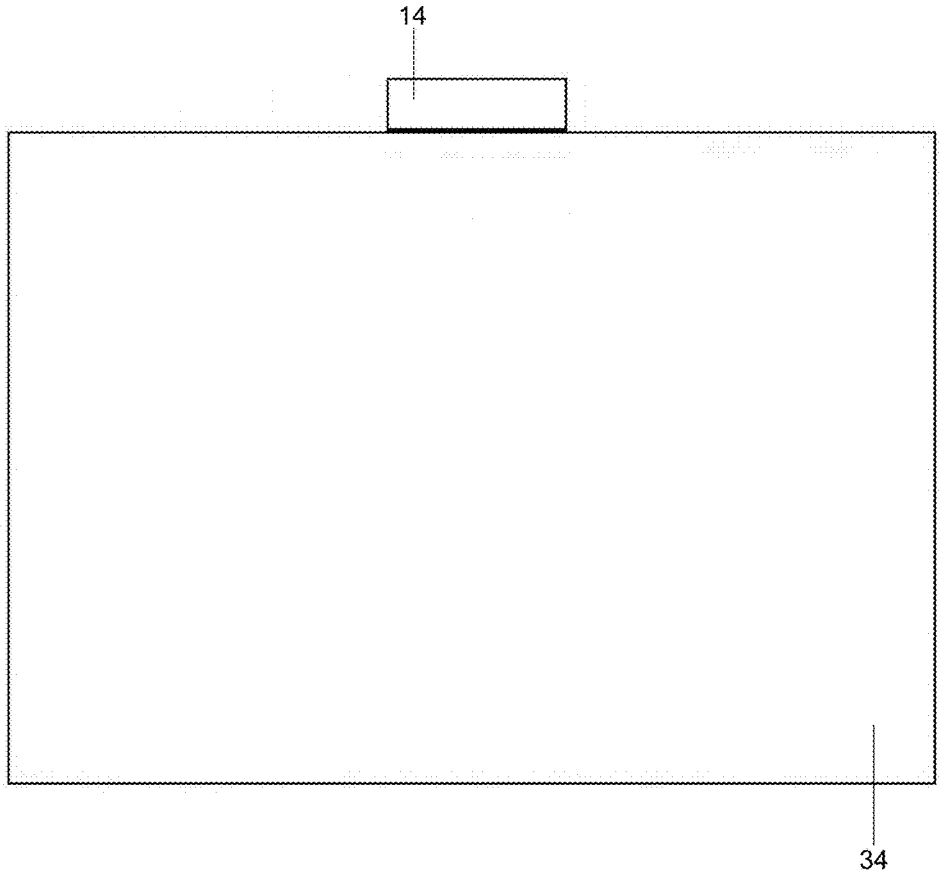
FIG. 3 is the back side view of the Customized Storage Calendar.

FIG. 3 if the back side view of the Customized Storage Calendar showing the backboard 34 and the right side insert month box 14 backside.

Figure 4:
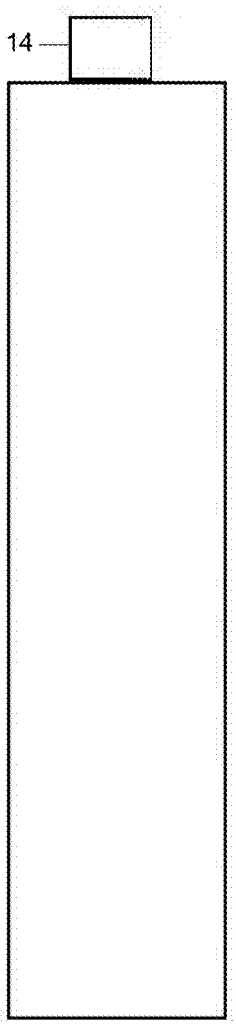
FIG. 4 is the left side view of the Customized Storage Calendar.

FIG. 4 if the left side view of the Customized Storage Calendar showing the month box 14 left wall and calendar frame left wall 26.

Figure 5:
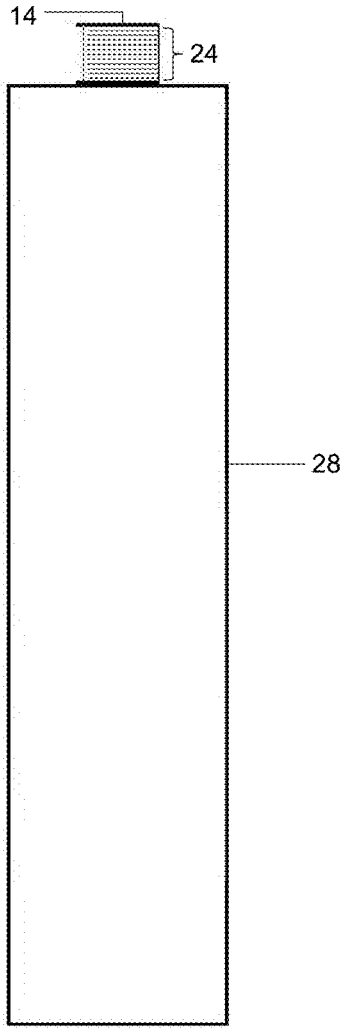
FIG. 5 is the right side view of the Customized Storage Calendar.

FIG. 5 if the right side view of the Customized Storage Calendar showing the month box 14 right side with month sliders 24 and calendar frame right wall 28.

Figure 6:
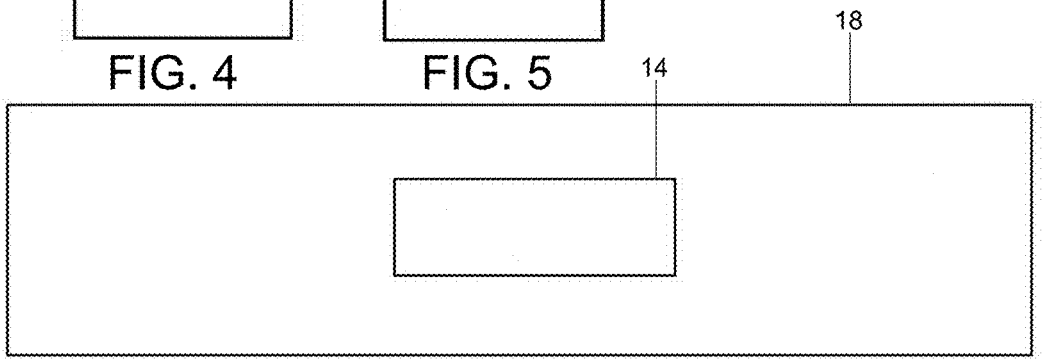
FIG. 6 is the top view of the Customized Storage Calendar.

FIG. 6 is the top view of the Customized Storage Calendar showing the top view of the month box 14 and calendar frame top wall 18.

Figure 7A:
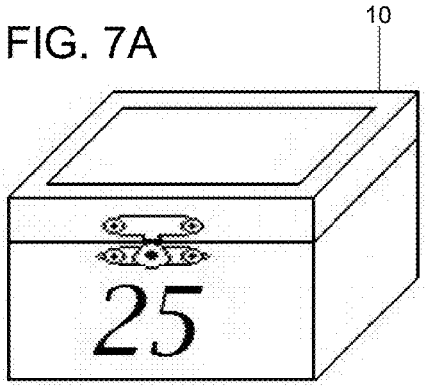
FIG. 7A is a perspective view of the dual-sided day box for day 25 in the closed position showing the display window.

FIG. 7A shows a perspective view of the dual-sided day box 10 for Day 25 of the Customized Storage Calendar invention configured as a devotional calendar when closed showing the display window. The thirty-one numbered dual-sided day boxes 10 have a front wall, back wall, side walls, top wall, and bottom wall that define a day box storage area. A day number is displayed on the front wall of the box. The top wall of the day box can be customized to display any positive subject matter. The top wall of the day box displays a biblical devotional verse when configured as a devotional calendar. When configured as a devotional calendar, the day boxes can be opened to insert various types of wrapped chocolates or candies and are made of wood, cardboard, or other durable material which display a verse for a daily spiritual devotional ritual and provide a means for portion controlled dessert. Portion controlled desserts are items such as off the shelf wrapped chocolates and wrapped mints. The fully assembled state of the day box 10 is a closed box with the display of information on the top wall of the box using the dual-sided insert 38. Day box closure hardware is optional.

The numbered dual-sided day boxes 10 can be rotated once the current day passes resulting in a clearer visualization of the present day. Likewise, for months with less than thirty-one days, the unused days can be rotated displaying the back wall of the box or removed from the calendar.

Figure 7B:
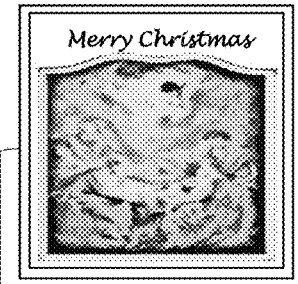
FIG. 7B is a perspective view of the holiday insert for day 25 to be displayed during the month of December.

FIG. 7B show is a perspective view of the holiday insert 38 for day 25 to be displayed during the month of December.

Figure 7C:
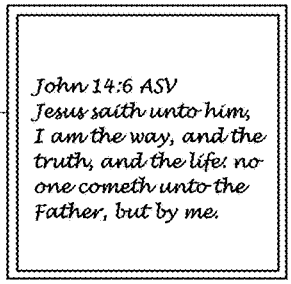
FIG. 7C is a perspective view of the insert displaying positive subject matter for day 25 during non-December months.

FIG. 7C show is a perspective view of the insert 38 displaying positive subject indicia for day 25 during the non-December months.

Figure 7D:
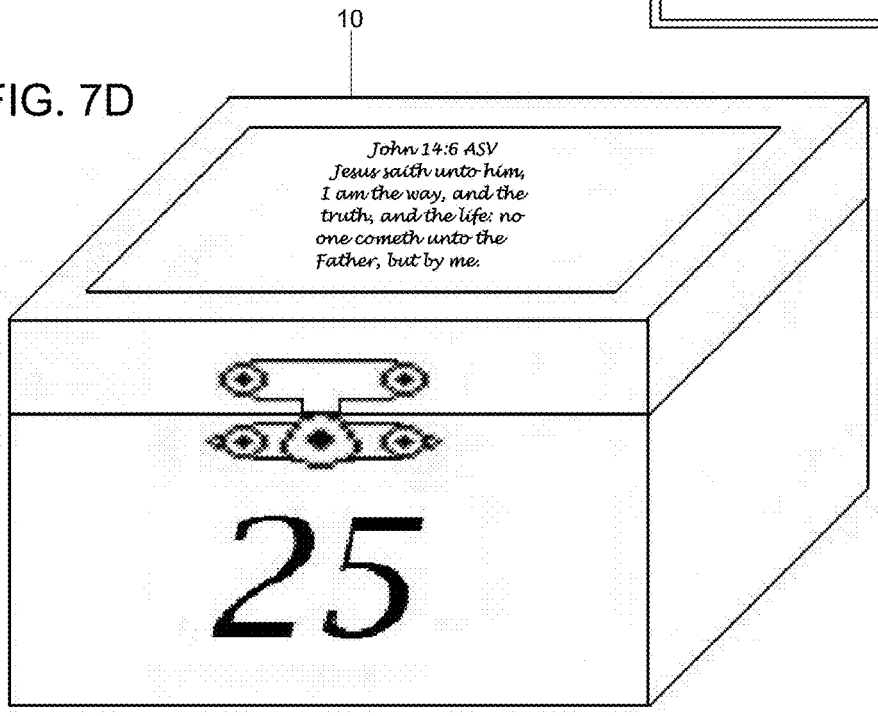
FIG. 7D is an exploded perspective view of the dual-sided day box for day 25 in the closed position displaying positive subject matter in the window.

FIG. 7D is an exploded view of the dual-sided day box 10.

Figure 7E:
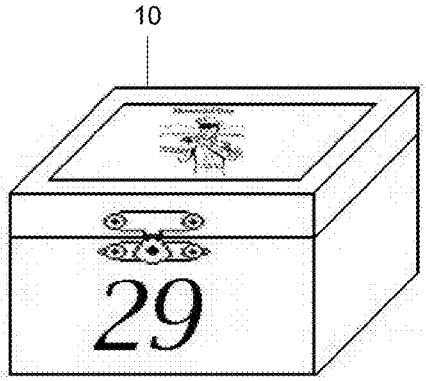
FIG. 7E is a perspective view of the dual-sided day box for day 29 to be displayed during the month of May of 2017.

FIG. 7E is a perspective view of the dual-sided day box 10 for day 29 to be displayed during the month of May of 2017.

Figure 7F:
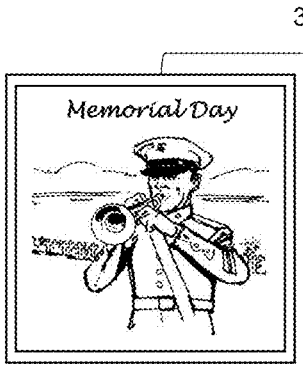
FIG. 7F is a perspective view of the holiday insert for day 29 to be displayed during the month of May 2017.
Figure 7G:
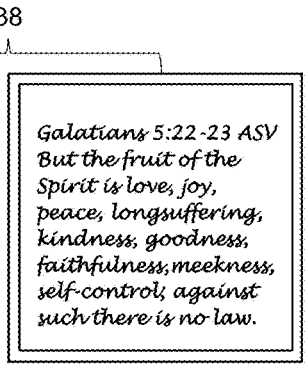
FIG. 7G is a perspective view of the insert displaying positive subject matter for day 29 during non-May months.

FIG. 7F is a perspective view of the holiday insert 38 for day 29 to be displayed during the month of May 2017. FIG. 7G is a perspective view of the insert 38 displaying positive subject matter for day 29 during non-May months.

Figure 7H:
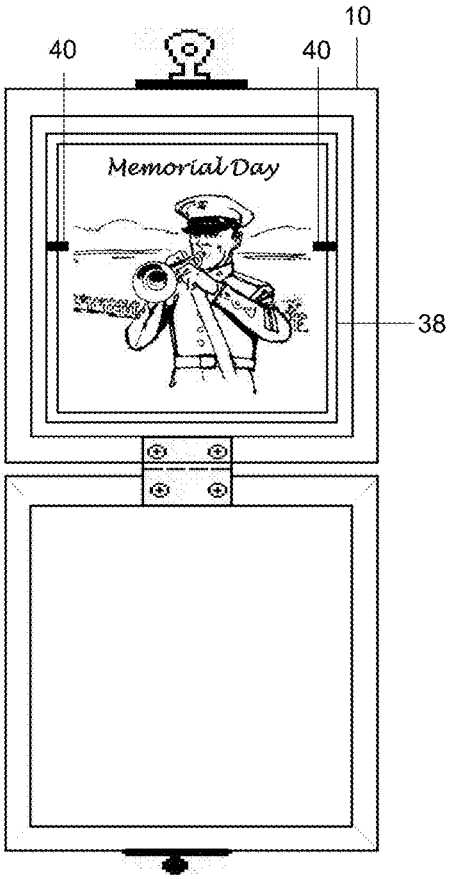
FIG. 7H is a top plan view of the dual-sided day box in the open position for day 29 during the non-May months 2017, illustrating the insert secured by tabs.

FIG. 7H is a top plan view of the dual-sided day box 10 in the open position for day 29 during the non-May months 2017, illustrating the insert 38 secured by tabs 40.

Figure 7I:
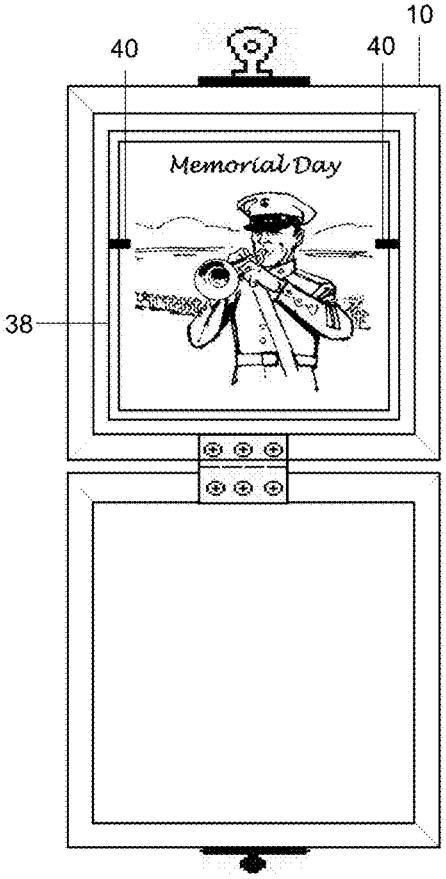
FIG. 7I is a top plan view of the day box in the open position for day 29 during the non-May months 2017, illustrating the insert secured by tabs.

FIG. 7I is a top plan view of the dual-sided day box 10 in the open position for day 29 during the non-May months 2017, illustrating the insert 38 secured by tabs 40.

Figure 8A:
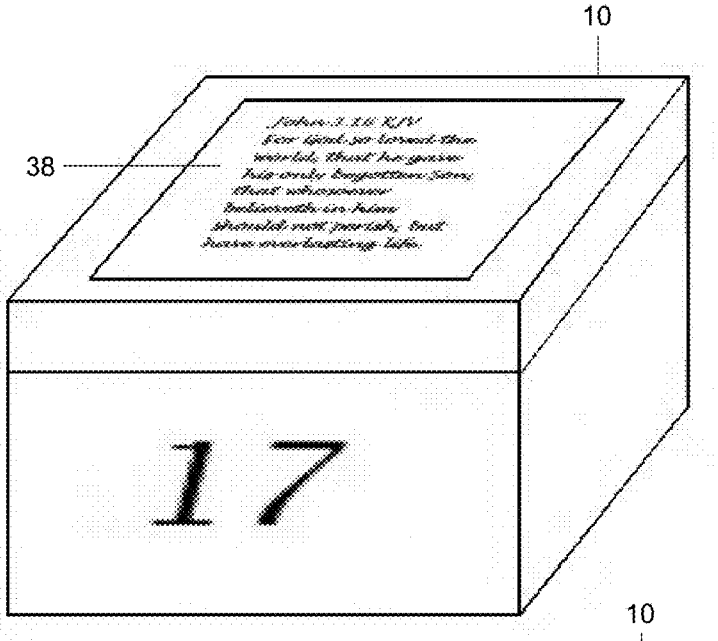
FIG. 8A and FIG. 8B are exploded perspective views of additional alternate embodiments of the day box displaying positive subject matter, insert secured by tabs.
Figure 8B:
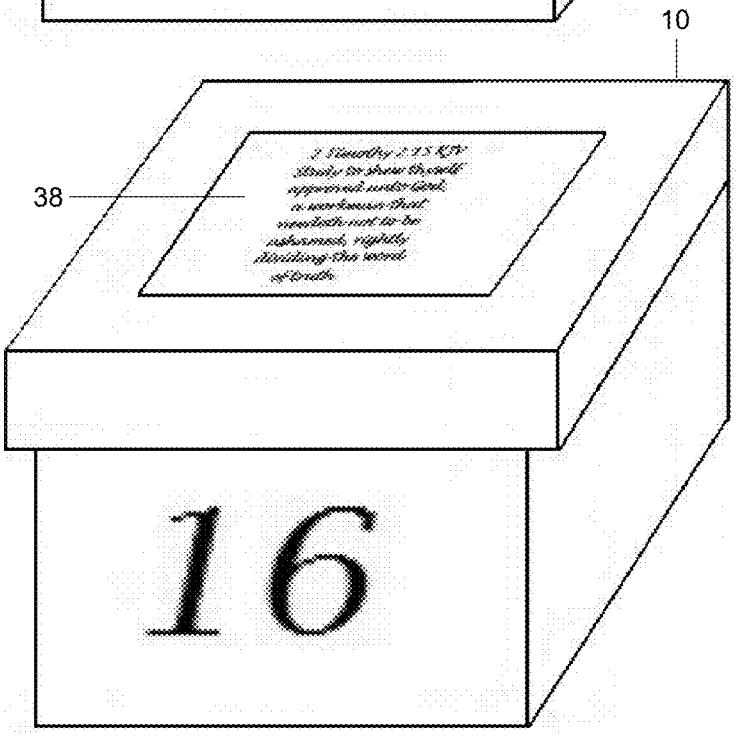

FIG. 8A and FIG. 8B are exploded perspective views of day box alternate embodiments 36 displaying positive subject indicia on the insert 38 secured by tabs 40.

Figure 9:
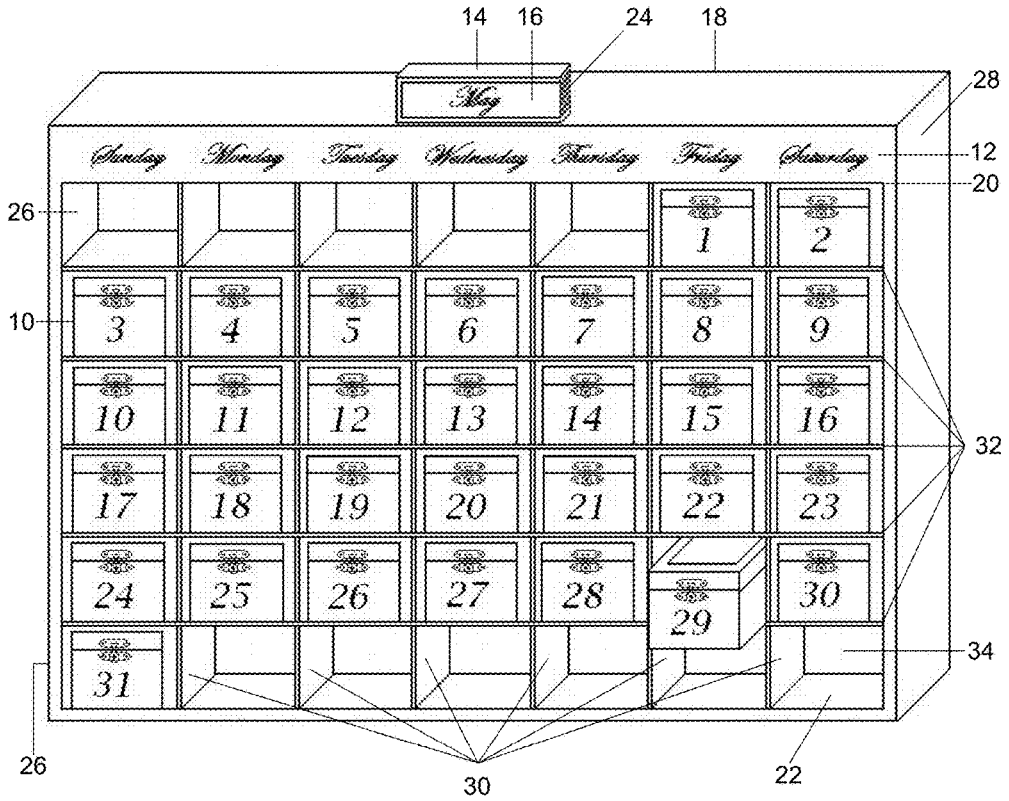
FIG. 9 is a perspective view of the Customized Storage Calendar to show the removable mounted thirty-one numbered dual-sided day boxes.

FIG. 9 is a perspective view of the assembled Customized Storage Calendar illustrating the removal of day box 29.

When configured as a devotional calendar, each day box has a day number displayed on the front wall and a unique biblical devotion verse on the top wall of each box. Additional verses can be added by utilizing the space opposite side of the top wall or any suitable display area of the day box. The devotional information displayed on the top wall of each box can be customized to display any positive subject area. For example, the boxes can be customized to display at least religious, inspirational, motivational, educational, task information and related insignia and this disclosure anticipates all of these options.

Calendar days is defined as all days in a month, including weekends and holidays. The notion of a holiday was frequently derived in association with religious observances allowing individuals to fulfill spiritual obligations on notable, honored calendar dates. Holidays have progressed over time and in many cultures they are a means to explore leisure and recreational activities. The Customized Storage Calendar can also comprise holiday boxes (New Year's Day, Valentine's Day, Happy Birthday, St. Patrick's Day, Easter, Mother's Day, Memorial Day, Father's Day, 4th of July, Columbus Day, Halloween, Veteran's Day, Thanksgiving, Christmas, etc.) as the definition of calendar days encompasses holidays and this disclosure anticipates this option. For example, the day box for day "25" would be removed from the calendar and replaced with the Christmas box for the corresponding day position in the month of December.

Figure 10:
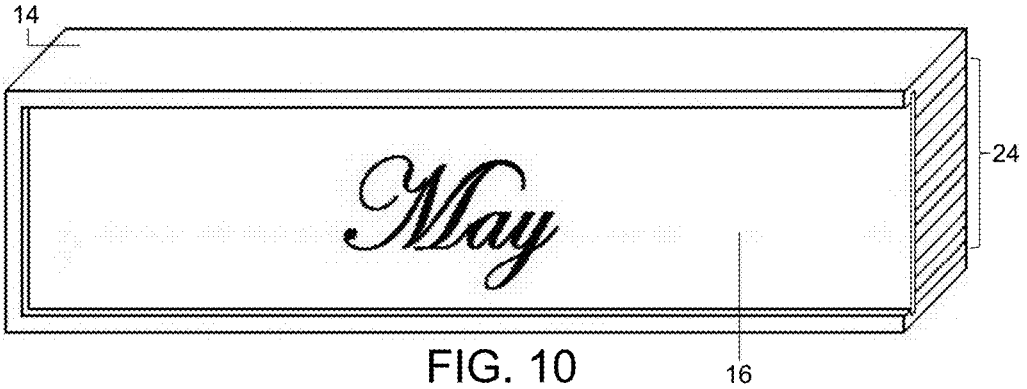
FIG. 10 is an exploded perspective view of the Calendar Month Box.

FIG. 10 shows an exploded perspective view of the month box 14. The month box 14 displays the current month slider 16 and stores the remainder non-current month sliders 24 in the hollow interior area of the month box. The month box 14 allows for the months to be easily swapped to display the current month, which easily slides out to change the month to be displayed. The month box is made of durable, cuttable material comprising a top wall, bottom wall, back wall, and a left side wall, that define a hollow interior box storage area and a front slot as displayed in FIG. 13C.

Figure 11:
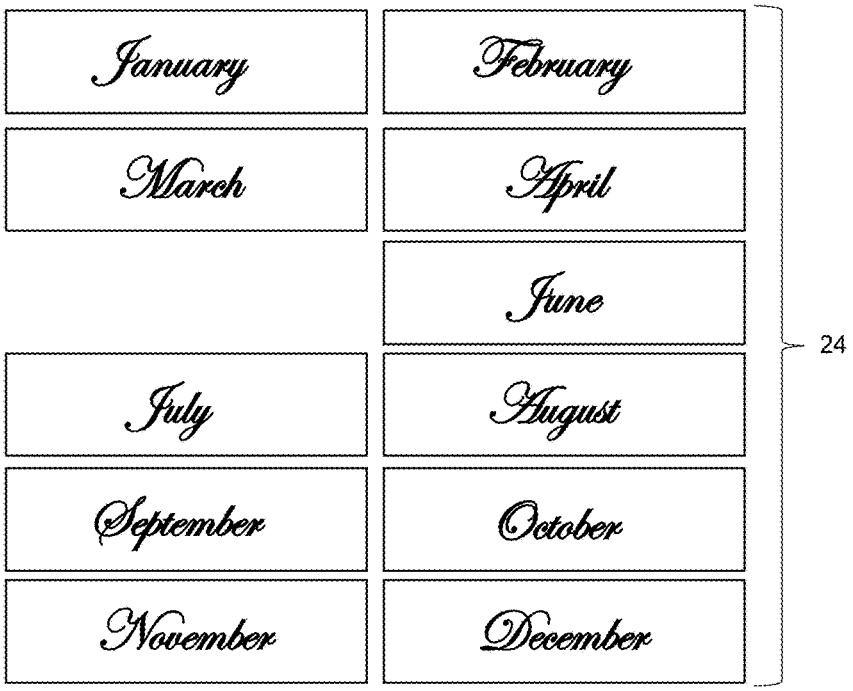
FIG. 11 is a front view of the Calendar's Non-Current Month Sliders.

FIG. 11 shows the front view of the calendar's non-current month sliders 24 when removed from the month box 14. The non-current month sliders are of wood, cardboard, or other material.

Figure 12:
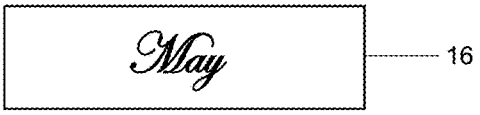
FIG. 12 is a front view of the Calendar's Current Month Slider.

FIG. 12 shows the front view of the calendar's current month slider 16 displaying the month of May as an example.

FIG. 13A is the front view of the Month Box 14 without any month sliders inserted. FIG. 13B is the top, bottom, and backside view of the Month Box 14 without any month sliders inserted. FIG. 13C is the right side view of the Month Box 14 displaying the front slot without any month slider inserted. FIG. 13D is the left side view of the Month Box 14 without any month sliders inserted.

FIG. 13E is the front view of the Month Box 14, without storing remainder month sliders, displaying the month of May to illustrate the sliding action of the Current Month Slider 16 being inserted. FIG. 13F is a perspective view of the Month Box 14, without storing remainder month sliders, displaying the month of May to illustrate the sliding action of the Current Month Slider 16 being inserted.

FIG. 13G is the front view of the Month Box 14, storing the remaining Non-Current Month Sliders 24, displaying the month of May to illustrate the sliding action of the Current Month Slider 16 being inserted. FIG. 13H is a perspective view of the Month Box 14, storing the remainder Non-Current Months Sliders 24, in the hollow interior area of the month box, displaying the month of May to illustrate the sliding action of the Current Month Slider 16 being inserted.

Figure 14:
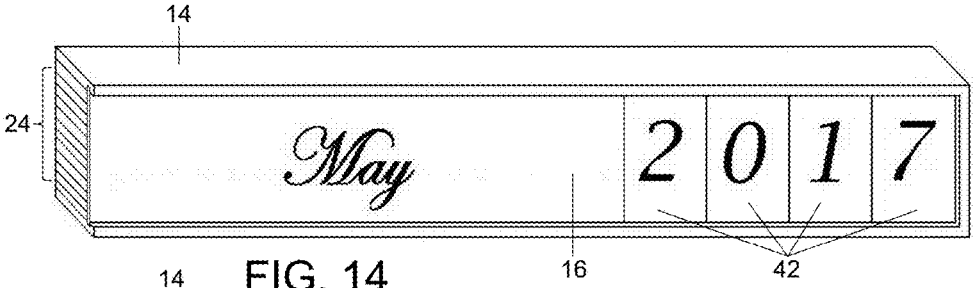
FIG. 14 is a perspective view of the month box configured for left side insert with optional year number slider.

FIG. 14 is a perspective view of the Month Box 14 configured for left side insert with optional year number slider 42, storing the remainder sliders 24 in the hollow interior storage area of the Month Box 14.

Figure 15:
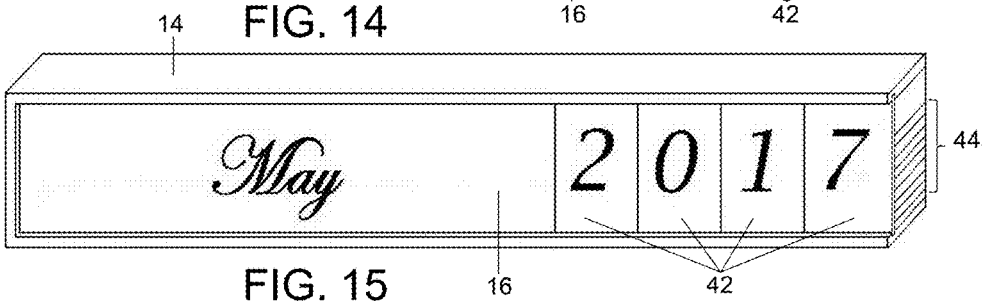
FIG. 15 is a perspective view of the month box configured for right side insert with optional year number slider.

FIG. 15 is a perspective view of the Month Box 14 configured for right side insert with optional year number slider 42, storing the remainder sliders 44 in the hollow interior storage area of the Month Box 14.

Figure 16:
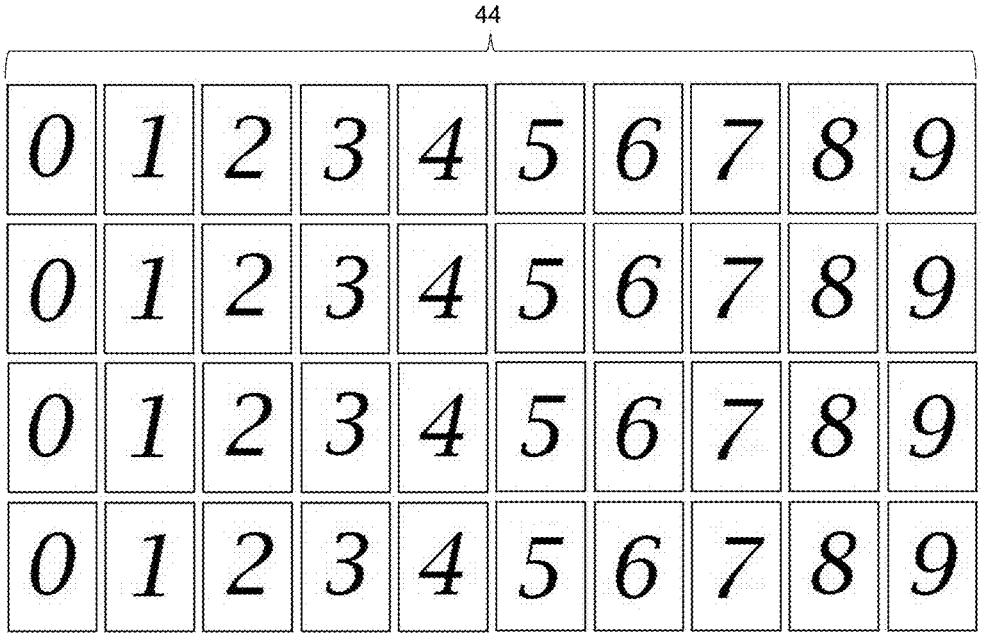
FIG. 16 is a front view of the year number sliders.

FIG. 16 is a front view of the year number sliders 44.

Figure 17:
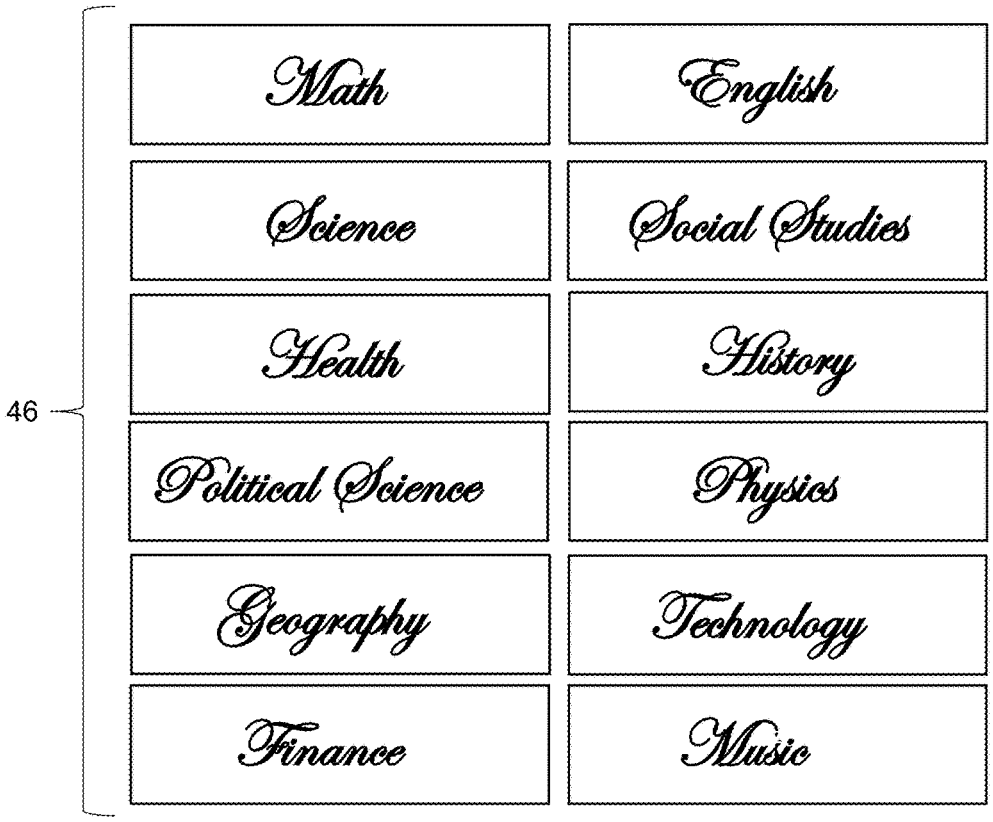
FIG. 17 is a view of optional sliders configured to display academia subjects.

FIG. 17 is a view of optional slider configuration, shown removed from the Month Box 14 for illustration purposes, in which the months of the year are displayed on the front side of the sliders and academia subjects 46 or positive subject indicia on the back side of the sliders.

FIG. 18A, FIG. 18B, and FIG. 18C are perspective view of the Six Wall Day Boxes 48. FIG. 18A is a front perspective view, FIG. 18B displays the view when rotated to the left twice, and FIG. 18C displays the view when rotated to the right once.

FIG. 18D is a front and back view of the dual-sided insert 38 for day 1. The front view of the dual-sided insert 38 displays holiday indicia for day 1 to be displayed during the month of January. The back view of the dual-sided insert 38 displays positive subject indicia during non-January months.

FIG. 18E is a front and back view of the dual-sided insert 38 for day 29 in the year 2017. The front view of the dual-sided insert 38 displays holiday indicia during the month of May. The back view of the dual-sided insert 38 displays positive subject indicia during non-May months.

Figure 18F:
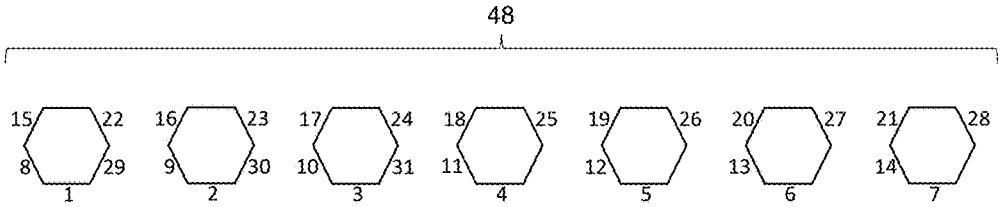
FIG. 18F is an illustration of the day numbers on the six walls of the seven day boxes.

FIG. 18F is an illustration of the day numbers on the six walls of the seven day boxes 48. Day box 1 encompasses days 1, 8, 15, 22, and 29. Day box 2 encompasses days 2, 9, 16, 23, and 30. Day box 3 encompasses days 3, 10, 17, 24, and 31. Day box 4 encompasses days 4, 11, 18, and 25. Day box 5 encompasses days 5, 12, 19, and 26. Day box 6 encompasses days 6, 13, 20, and 27. Day box 7 encompasses days 7, 14, 21, and 28.

Figure 19:
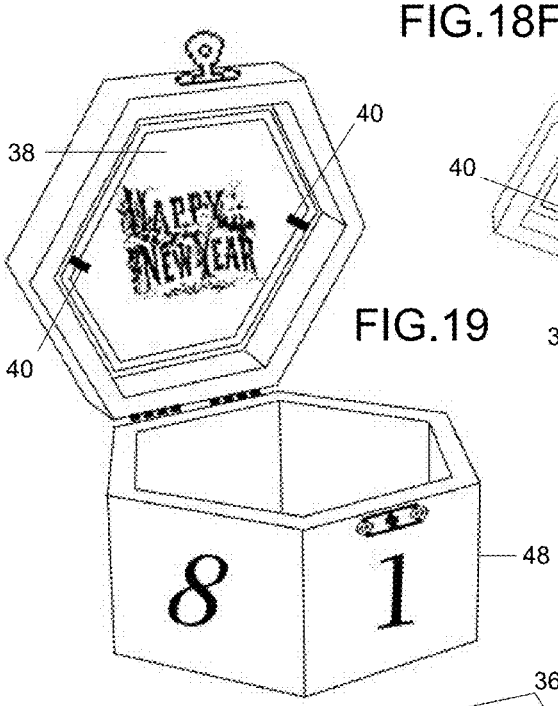
FIG. 19 is a perspective view of the interior of a six wall day box in the open position.
Figure 20A:
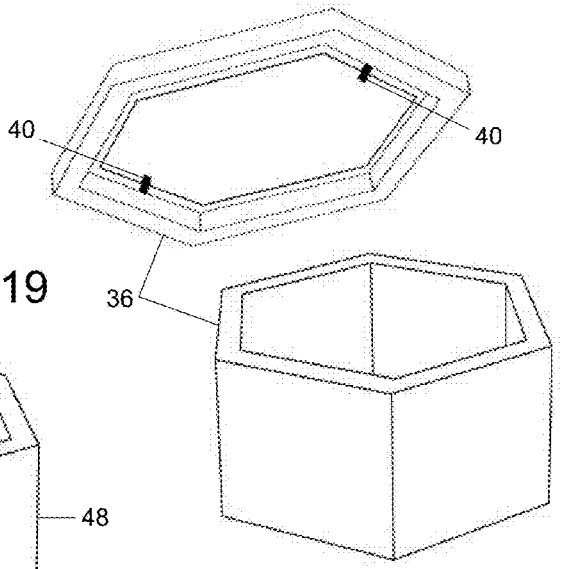
FIG. 20A and FIG. 20B are alternate embodiments of the six wall day box.
Figure 20B:
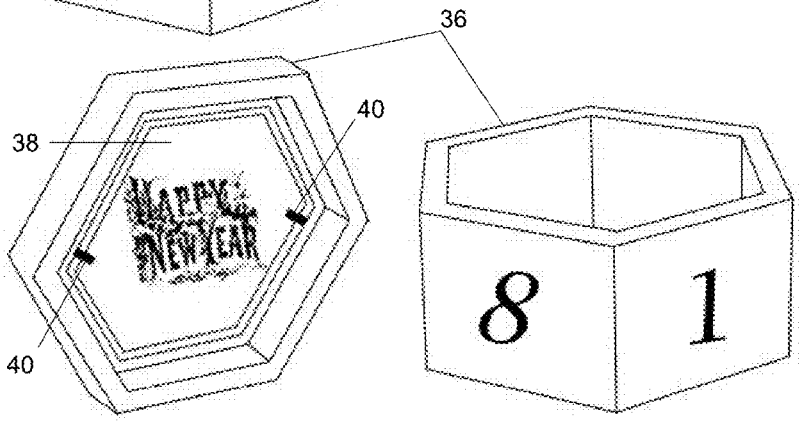

FIG. 19 is a perspective view of the interior of a six wall day box 48 in the open position for day 1 during the non-January months, illustrating the insert 38 secured by tabs 40;

FIG. 20A and FIG. 20B are alternate embodiments of the six wall day box 48 illustrating customizable positive subject indicia displayed on the insert 38 secured by tabs 40 and storage capability.

Figure 20C:
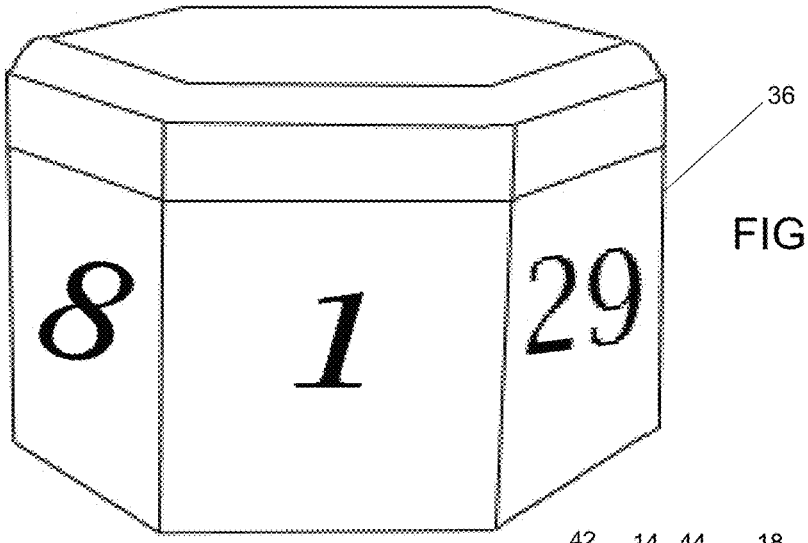
FIG. 20C is an exploded perspective view of a six wall day box.

FIG. 20C is an exploded perspective view of an alternate embodiment of a six wall day box 48 in the closed position.

Figure 21:
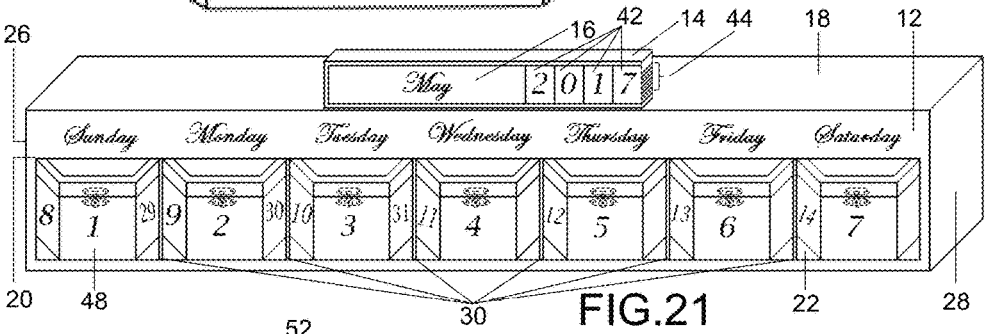
FIG. 21 is a perspective view of the Customized Storage Calendar configured with six-wall day boxes.

FIG. 21 is a perspective view of the customized storage calendar configured with seven six wall day boxes 48 and a right side insert month box 14 with year number sliders 44. The six wall day boxes 48 are removable mounted within the compartments, rotating the day box to the left or right to display the day number.

Figure 22A:
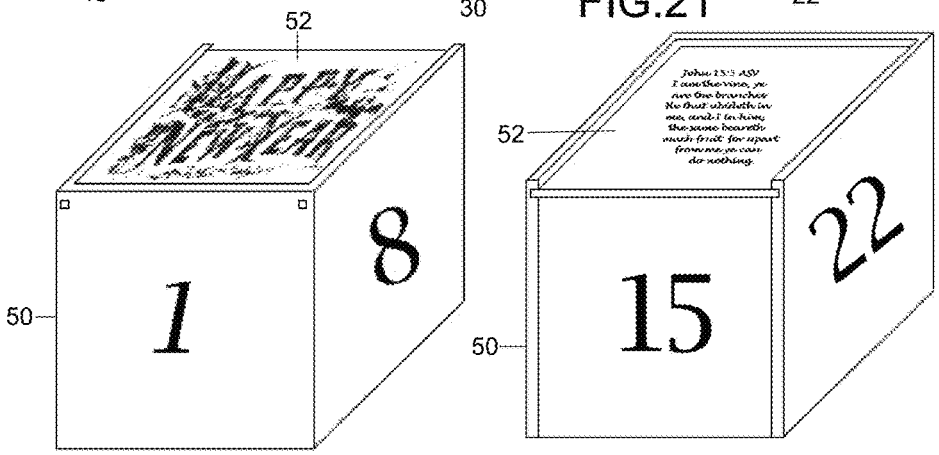
FIG. 22A is a perspective view of cube day boxes with a top wall slider.

FIG. 22A is a perspective view of cube day boxes 50 with a dual-sided top wall slider 52 which is removable received in the top slot of the cube day box 50.

Figure 22B:
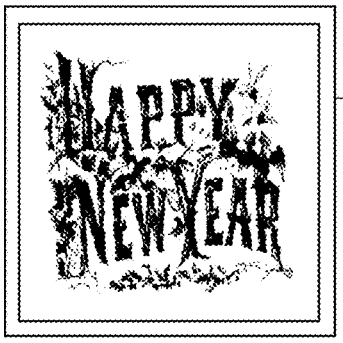
FIG. 22B are perspective views of the top wall slider for day 1.
Figure 22B:
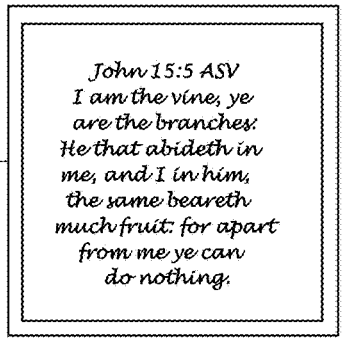

FIG. 22B are perspective views of the top wall slider 52 for day 1 to be displayed during January and non-January months, respectively.

Figure 22C:
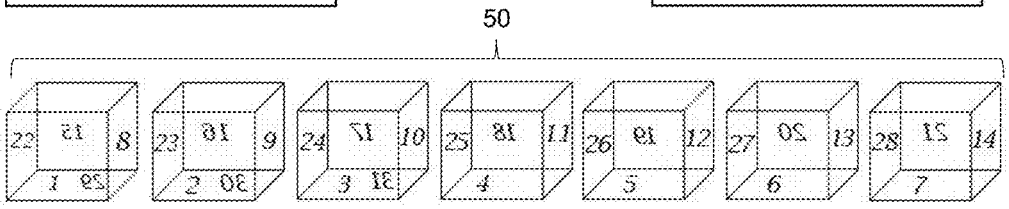
FIG. 22C is an illustration of the day numbers on the walls of the seven cube day boxes.

FIG. 22C is an illustration of the day numbers on the walls of the seven cube day boxes 50. Cube day box 1 encompasses days 1, 8, 15, 22, and 29. Cube day box 2 encompasses days 2, 9, 16, 23, and 30. Cube day box 3 encompasses days 3, 10, 17, 24, and 31. Cube day box 4 encompasses days 4, 11, 18, and 25. Cube day box 5 encompasses days 5, 12, 19, and 26. Cube day box 6 encompasses days 6, 13, 20, and 27. Cube day box 7 encompasses days 7, 14, 21, and 28.

Figure 23A:
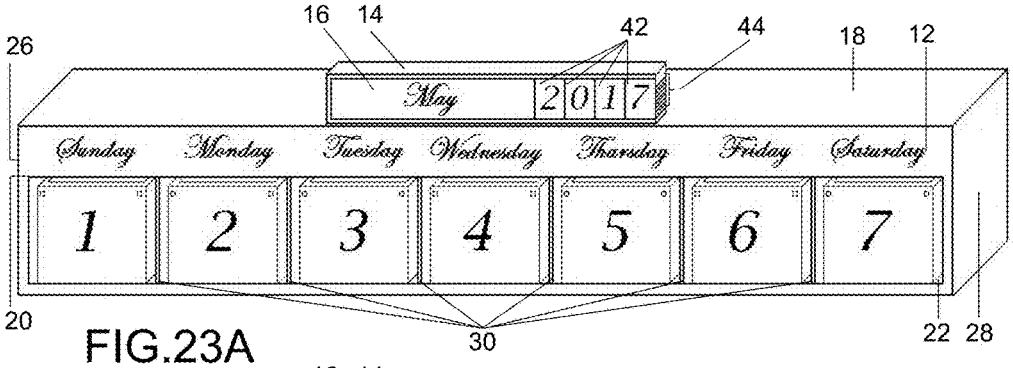
FIG. 23A and FIG. 23B are perspective views of the Customized Storage Calendar configured with cube day boxes.
Figure 23B:
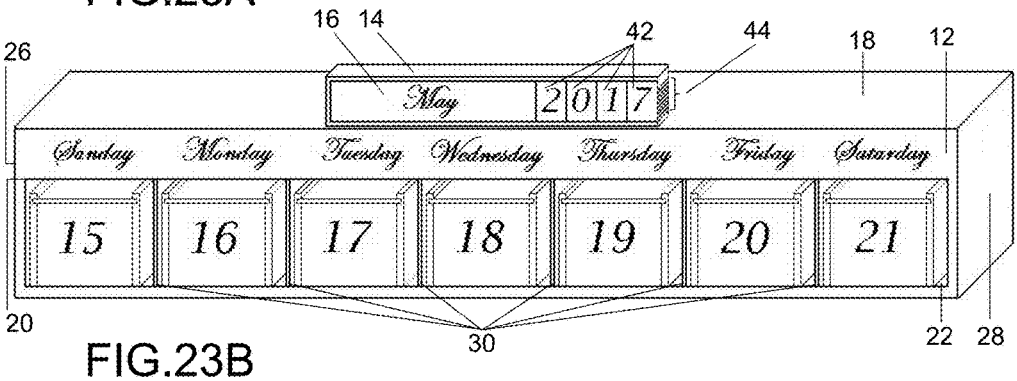

FIG. 23A and FIG. 23B are perspective views of the Customized Storage Calendar configured with seven cube day boxes 50 and a right side insert month box 14 with year number sliders 44.

When the Customized Storage Calendar is configured as a devotional calendar, the thirty-one day boxes are removed and opened for dessert chocolates to be placed in the boxes. The thirty-one day boxes are then closed and placed back in the devotional calendar. After dinner, the current day box is removed from the calendar and the devotional scripture on the top wall of the box is read. Then the current day box is opened for dessert chocolates to be consumed and/or shared. The current day box is placed back into the devotional calendar.

Although the description and drawings contain many specificities, these should not be construed as limiting the scope of the invention. The visible representation shown in the drawings and described above are for illustrative purposes, and are not intended to limit scope of the invention as defined in claims that follow. For example, joints can be used to secure the compartments to the calendar frame versus being glued. The illustrated Vertical Partitions 30 can have a tenon on the top end of the vertical partition and a mortise on the Horizontal Support Member 20 which can join to form a joint thus securing without the need for glue. Likewise, the illustrated Vertical Partitions 30 can have a tenon on the bottom end of the vertical partition and a mortise on the Bottom Wall 22 which can join a joint thus securing without the need for glue. Furthermore, the numbered cube day boxes can have the day number displayed on the front wall of 31 cube day boxes and positive subject indicia displayed on the dual-sided removable Top Wall Slider 52 for use in the 42 compartment Customized Storage Calendar illustrated in FIG. 1, in lieu of the Dual-sided Day Boxes 10 that are configured with the removable insert 38. Thus, the scope of the invention encompasses not only the disclosed illustrated representation of the invention, but also all equivalent ways of practicing or implementing the invention as defined in claims that follow.

What is claimed is:

1. A Customized Storage Calendar comprising:

thirty-one numbered day boxes made of durable, cuttable material having a front wall, back wall, side walls, a top wall and bottom wall that define a day box storage area wherein each day box is adapted to receive and store an object therein; positive subject indicia displayed on the top wall on a removable dual-sided insert secured by tabs and a day number displayed on the front wall;

a month box configured as left or right side insert made of durable, cuttable material comprising a top wall, bottom wall, a back wall, and a left side wall for right side insert or a right side wall for left side insert, that define a hollow interior box storage area and a front slot;

twelve month sliders, wherein each slider displays a month of the year, wherein one of the month sliders is removable received in the front slot of the month box and a remainder of the month sliders are stored in the interior box storage area;

forty year sliders, wherein each year slider displays a number, wherein four of the year sliders are removable received in the front slot of the month box and a remainder of the year sliders are stored in the interior box storage area;

a calendar frame comprising a top wall, bottom wall, left wall, right wall, six vertical partitions, five horizontal partitions configured as six rows and seven columns, and backboard to define compartments;

a horizontal support member mounted on top of the six vertical partitions;

a week face plate having seven days of the week displayed thereon, the week face plate is sandwiched between the top wall of the calendar frame and the horizontal support member, and the month box is removable mounted on top of the calendar frame top wall;

wherein the thirty-one numbered day boxes are removable mounted within the compartments and wherein each day box is adapted to receive and store an object therein.

2. The Customized Storage Calendar of claim 1, wherein each of the twelve month sliders further comprising academia subject or positive subject indicia on the back side.

3. A Customized Storage Calendar comprising:

seven numbered day boxes made of durable, cuttable material having six walls that define a day box storage area; positive subject indicia displayed on a removable dual sided top wall slider and a day number displayed on the six walls;

a month box configured as left or right side insert made of durable, cuttable material comprising a top wall, bottom wall, a back wall, and a left side wall for right side insert or a right side wall for left side insert that define a hollow interior box storage area and a front slot;

twelve month sliders, wherein each slider displays a month of the year, wherein one of the month sliders is removable received in the front slot of the month box and a remainder of the month sliders are stored in the interior box storage area;

forty year sliders, wherein each slider displays a number, wherein four of the year sliders are removable received in the front slot of the month box and a remainder of the year sliders are stored in the interior box storage area;

a calendar frame comprising a top wall, bottom wall, left wall, right wall, six vertical partitions configured as one row and seven columns, and backboard to define compartments;

a horizontal support member mounted on top of the six vertical partitions;

a week face plate having seven days of the week displayed thereon, the week face plate is sandwiched between the top wall of the calendar frame and the horizontal support member, and the month box is removable mounted on top of the calendar frame top wall;

wherein the seven numbered day boxes are removable mounted within the compartments, rotating the day box to the left or right to display the day number, and wherein each day box is adapted to receive and store an object therein.

4. A Customized Storage Calendar of claim 3, wherein the twelve month sliders further comprising academia subject or positive subject indicia on the back side.

5. A Customized Storage Calendar comprising:

seven numbered cube day boxes made of durable, cuttable material having five walls consisting of a front wall, back wall, side walls, bottom wall, and a removable dual sided top wall slider that define a day box storage area; positive subject indicia displayed on the dual-sided removable top wall slider and a day number displayed on at least four of the five walls;

at least seven dual-sided top wall sliders, wherein each slider displays positive subject indicia on the front and back side, wherein one of the top wall sliders is removable received in the top slot of the cube day box;

a month box configured as left or right side insert made of durable, cuttable material comprising a top wall, bottom wall, a back wall, and a left side wall for right side insert or a right side wall for left side insert that define a hollow interior box storage area and a front slot;

twelve month sliders, wherein each slider displays a month of the year, wherein one of the month sliders is removable received in the front slot of the month box and a remainder of the month sliders are stored in the interior box storage area;

forty year sliders, wherein each slider displays a number, wherein four of the year sliders are removable received in the front slot of the month box and a remainder of the year sliders are stored in the interior box storage area;

a calendar frame comprising a top wall, bottom wall, left wall, right wall, six vertical partitions configured as one row and seven columns, and backboard to define compartments;

a horizontal support member mounted on top of the six vertical partitions;

a week face plate having seven days of the week displayed thereon, the week face plate is sandwiched between the top wall of the calendar frame and the horizontal support member, and the month box is removable mounted on top of the calendar frame top wall;

wherein the seven numbered cube day boxes are removable mounted within the compartments, rotating the day box to display the day number, and wherein each day box is adapted to receive and store an object therein.

6. A Customized Storage Calendar of claim 5, wherein the twelve month sliders further comprising academia subject or positive subject indicia on the back side.

* * * * *